United States Patent [19]

Thureson et al.

[11] Patent Number: 4,757,764

[45] Date of Patent: Jul. 19, 1988

[54] NONELECTRIC BLASTING INITIATION SIGNAL CONTROL SYSTEM, METHOD AND TRANSMISSION DEVICE THEREFOR

[75] Inventors: Gary R. Thureson, Avon; Ernest L. Gladden, Granby, both of Conn.

[73] Assignee: The Ensign-Bickford Company, Simsbury, Conn.

[21] Appl. No.: 811,731

[22] Filed: Dec. 20, 1985

[51] Int. Cl.[4] ..... F42B 3/00

[52] U.S. Cl. ..... 102/312; 102/313; 102/275.8

[58] Field of Search ..... 102/312, 313, 275.5 F, 102/275.8, 321; 299/13

[56] References Cited

U.S. PATENT DOCUMENTS

| | | | |
|---|---|---|---|
| 3,590,739 | 7/1971 | Persson | 102/27 |
| 3,878,785 | 4/1975 | Lundborg | 102/27 R |
| 3,885,499 | 5/1975 | Hurley | 102/23 |
| 3,902,422 | 9/1975 | Coursen | 102/312 X |
| 3,939,772 | 2/1976 | Zebree | 102/22 |
| 3,987,733 | 10/1976 | Spraggs et al. | 102/27 R |
| 4,056,059 | 11/1977 | Zebree | 102/22 R |
| 4,073,235 | 2/1978 | Hopler, Jr. | 102/22 |
| 4,141,296 | 2/1979 | Calder, Jr. et al. | 102/24 R |
| 4,146,429 | 3/1979 | Slagley | 102/312 X |
| 4,220,087 | 9/1980 | Posson | 102/27 R |
| 4,290,366 | 9/1981 | Janoski | 102/202.3 |
| 4,328,753 | 5/1982 | Kristensen et al. | 102/275.5 |
| 4,333,684 | 6/1982 | Ricketts et al. | 102/312 X |
| 4,350,097 | 9/1982 | Bowman et al. | 102/275.2 |
| 4,396,231 | 8/1983 | Ricketts | 102/312 X |
| 4,406,226 | 9/1983 | Davitt et al. | 102/320 X |
| 4,607,573 | 8/1986 | Thureston et al. | 102/275.8 |
| 4,660,474 | 4/1987 | Dias dos Santos | 102/275.8 |

FOREIGN PATENT DOCUMENTS

| | | |
|---|---|---|
| 8400206 | 11/1984 | Brazil . |
| 2300320 | 9/1976 | France . |
| 2347651 | 11/1987 | France . |
| 1566071 | 4/1980 | United Kingdom . |

*Primary Examiner*—Peter A. Nelson

*Attorney, Agent, or Firm*—Hayes & Reinsmith

[57] ABSTRACT

A nonelectric blasting system, method and device is disclosed for use in establishing a time sequential firing of blasting elements, the device comprised of an elongated tube which contains a low velocity deflagration mixture adhered to the inner walls of said tube. The device, by itself, controls a desired initiation pattern of a plurality of blasting elements by transmitting an initiation signal at a much reduced velocity than conventional shock tube or explosive cord by use of preselected material mixtures.

16 Claims, 9 Drawing Sheets

NONELECTRIC BLASTING INITIATION SIGNAL CONTROL SYSTEM, METHOD AND TRANSMISSION DEVICE THEREFOR

BACKGROUND OF THE INVENTION

This invention pertains to a system, method and device for the time controlled transmission of an initiation signal from an initiation source to remote blasting elements without the use of lumped delay units.

Typically, mining operations such as quarry excavation, mineral mining and the like require a minimum time separation of 8 milliseconds between detonation of explosive or blasting charges to meet governmental regulations. Conventional detonating cords transmit an initiation signal at a rate of between 5,000–30,000 feet per second or 1,500–9,000 meter/sec. (m/sec). Such propagation rates would require the use of cord lengths in a range of 152–184 feet to achieve the minimum required time delay interval. Similarly, shock tube, such as that described in U.S. Pat. No. 3,590,739, propagates a signal at approximately 6,500 ft/sec, which would require approximately 53 feet of tube to achieve the 8 millisecond delay. Either of these products could conceivably be used to achieve the desired delay interval, but the quantity of product needed is obviously excessive and uneconomical. Safety Fuse$^R$, an ordinary combustion product propagates a signal at 0.025 ft/sec and is obviously much too slow to transmit the signal. For this reason various delay devices, such as delay elements in detonators, have been incorporated into blasting systems using detonating cord or shock tube to reduce the cord or tube quantities to more manageable lengths.

OBJECTS OF THE INVENTION

With the foregoing considerations in mind, an object of the present invention is to provide a blasting system, method and device which will overcome all the inherent objections of prior art systems which incorporate lumped delay elements and which will permit a blasting foreman to have the option to control the desired sequential initiation of blasting elements without using such lumped delay elements.

Another object of the present invention is to provide a signal transmission system, method and device for the time controlled initiation of a plurality of blasting elements wherein the initiation pattern is determined by a device having a predetermined selective signal propagation rate less than standard detonating cord or shock tube but greater than combustion fuse.

Still another object of the present invention is to provide a signal transmission device for use in a blasting system which functions as the initiation signal control thereby eliminating the necessity for all lumped delay elements, electric or non electric, and cumbersome initiation equipment, and which exhibits high efficiency operation for controlling the pattern of initiation of a plurality of blasting elements.

Still another object of the present invention is to provide a blasting control system and method which combine the signal transmission device of this invention with conventional blasting elements so as to provide a comparatively low cost versatile control system for general blasting use.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

The system of the present invention comprises a plurality of individual blasting elements, initiation signal source means and transmission means for transmitting a signal from the initiation signal source means to the individual blasting elements. The transmission means include a plurality of discrete transmission lines connected to selected blasting elements, each of the transmission lines having a substantially uniform signal transmission rate per unit length of line to solely determine and control the pattern of initiation of the plurality of blasting elements.

The signal transmission line comprises a tube having a central passageway therethrough and a deflagrating material with a predetermined signal propagation rate of less than detonating material but greater than burning material adhered to the inner surface of the tube for propagation of a signal within the passageway.

BRIEF DESCRIPTION OF THE DRAWING

A more complete understanding of the invention may be had by reference to the following detailed description when taken in conjunction with the accompanying drawings wherein.

EMBODIMENTS OF THE INVENTION

The invention is illustrated with reference to the drawings of FIGS. 1–10, inclusive, wherein different embodiments of the blasting system and device of the present invention are shown in the context of a blast site containing a plurality of boreholes spaced apart in a predetermined pattern in an earth formation. It is to be understood that the drawings of FIG. 1–4 and 6–10 illustrate only the surface elements of the systems depicted.

Figure 1:
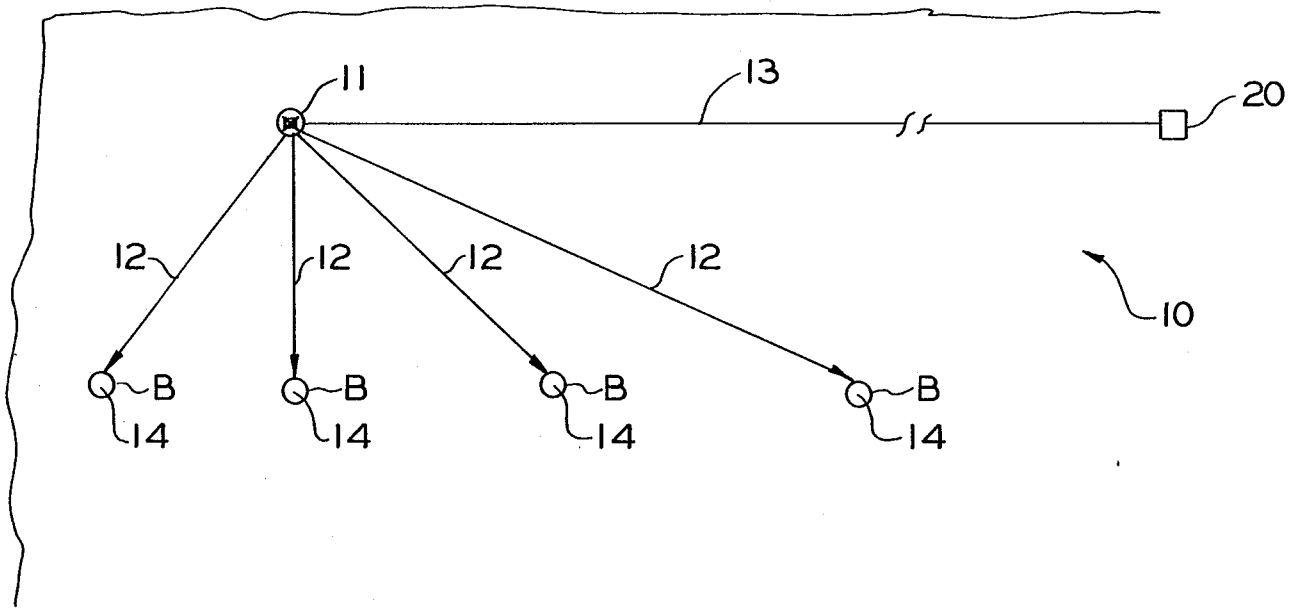
FIG. 1 is a schematic plan view of an embodiment of a blasting system of this invention having a plurality of randomly placed blasting elements.

Thus, FIG. 1 illustrates a blasting system 10 in accordance with the present invention containing a plurality of separate blasting elements 14 within boreholes B. Such blasting elements may be bulk explosive, boosters, primers, delay elements and the like which are typically employed in nonelectric blasting system. Several discrete signal transmission lines 12 of the present invention extend from a signal initiation source 20, such as an initiating detonator, shock tube blasting cap or the like, to the separate blasting elements 14.

The desired time interval between and/or among the initiation of blasting elements 14 is established in the systems of this invention according to the propagation rate of the signal transmission line 12. According to the invention, the time interval of initiation of pattern of initiation of a plurality of blasting elements is controlled by either of two contemplated methods. The first method is the incorporation of a length of signal transmission line having a preselected substantially uniform rate of propagation thereby requiring different lengths of such lines to be interposed between individual blasting elements. A second method of controlling the time sequential initiation of individual blasting elements is to provide lines having different preselected substantial uniform signal propagation rates and place lines of different rates between blasting elements. Either of these methods will insure successive firing of the blasting elements in any desired initiation pattern. It is to be understood that the term pattern initiation as used herein denotes the nonsimultaneous initiation of a plurality of blasting charges in a time controlled manner according to preselected blasting requirements.

Figure 6:
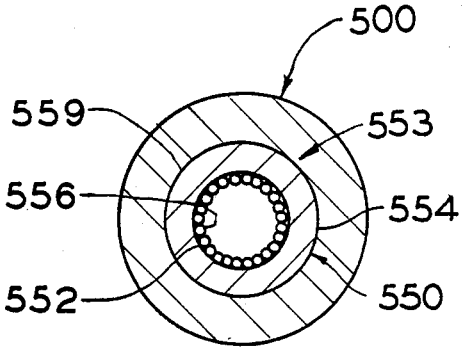
FIGS. 6 and 7 are cross sections of the signal transmission tube of this invention.
Figure 7:
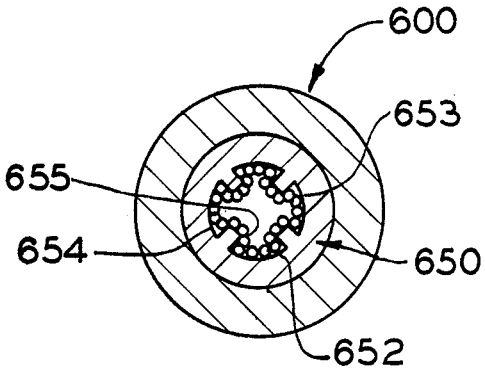

To better explain the signal transmission line which functions as the time control element of the system, reference is now made to FIGS. 6 and 7. The signal transmission line 500 comprises a plastic elongated inner tube 550 extruded from plastic materials such as Surlyin 8940 (registered trademark of E. I. du Pont de Nemours & Co. Incorporated), EAA (ethylene/acrylate acid copolymer), EVA (ethylene vinyl acetate) or the like, such plastics having adhesive properties providing for excellent adhesion surfaces for adhering reactive materials such as deflagrating materials 552 to inner surface 554 of inner tube 550. Deflagarating material 552, comprised of a powder mixture of such materials as silicon/red lead ($Si/Pb_3O_4$), molydbenum/potassium perchlorate ($Mo/KClO_4$), tungsten/potassium perchlorate ($W/KClo_4$), titanium hydride/potassium perchlorate ($TiH_2/KClO_4$) and zirconium/ferric oxide, is coated into inner surface of tube. Other compositions contemplated for use to control the propagation rate are boron/red lead ($B/Pb_3O_4$), titanium/potassium perchlorate ($Ti/KClO_4$), zirconium/potassium perchlorate ($Zr/KClO_4$), aluminum/potassium perchlorate ($Al/KClO_4$), zirconium hydride/potassium perchlorate ($ZrH_2/KClO_4$), manganese/potassium perchlorate ($Mn/KClO_4$), zirconium nickel alloys/red lead ($ZrNi/Pb_3O_4$), boron/barium sulfate ($B/BaSO_4$), titanium/barium sulfate $Ti/BaSO_4$), zirconium/barium sulfate ($Zr/BaSO_4$), boron/calcium chromate ($B/CaCrO_4$), zirconium/ferric oxide ($Zr/Fe_2O_3$), titanium-stannic oxide ($Ti/SnO_2$), titanium hydride/red lead ($TiH_2/Pb_3O_4$), titanium hydride/lead chromate ($TiH_2/PbCrO_4$), and tungsten/red lead ($W/Pb_3O_4$).

Passageway 556 extends the length of tube to propagate the deflagrating reaction of matreial 552 for the transmission of initiation signal. An outer layer or coating 558 may be applied to outer surface 559 of first tube to improve the ability of transmission tube to withstand external damage and mechanical stress. Suitable materials for outer coating 558 are poly-olefins, including, but not limited to linear low density polyethylene, linear medium density polyethylene, low density polyethylene, blends of linear low density polyethylene with ionomer, polypropylene, polybutylene, nylon, and blends of nylon with co-extrudible adhesives. It is to be understood that the term deflagrating material is used herein means a material which undergoes very rapid autocombustion and radiation. Deflagrating materials burn much quicker than ordinary combustion materials and are to be distinguished from detonating materials which produce a shock wave. Velocities of the deflagrating materials discussed herein are in the approximate range of 100 feet per second to 5,000 feet per second.

The linear signal propagation rate of the transmission tube may also be adjusted by the addition of gas generating materials such as, but not limited to, propellants (i.e. FNH) and explosives such as PETN, RDX, HMX and PYX. The addition of a third component to the reactive material such as a fuel or oxidizer of greater or lesser reactivity, an inert material, a propellant, or an explosive is contemplated to better control the linear reaction rate. Alternatively, the deflagrating material can be processed with polymeric compounds such as fluroinated hydrocarbons Viton$^R$A, KEL-F$^R$ and VAAR$^R$, a vinyl resin, and the like. Such polymers inhibit the deflagrating reaction of the compounds allowing for increased control of the propagation rate. The typical quantity of deflagrating material used is 2–500 mg/m of tube.

Variations in tube structure as well as the pyrotechnic formulation and composition permit the control and variation of the propagation rate.

FIG. 7 shows an embodiment of the transmission tube 600 having radially inwardly extending rectangular projections 653 integrally formed on inner surface 652 of inner tube 650. Provided between the projection portions and within channel 655 formed thereby is the deflagrating composition 654 of the present invention.

The propagation of signal within transmission line is transmitting at a consistent uniform speed along the length of the tube at a reduced velocity from standard explosive transmission tube devices. The transmission mechanism is not strictly that of the "shock wave" phenomenon as seen with explosive transmission tube devices, such as the shock tube type fuse as described in U.S. Pat. No. 3,590,739, but rather the signal is transmitted by means of a "pressure/flame front" principle. The deflagrating material components lining the tube are responsible for effectively maintaining transmission of the signal at a reduced velocity from that of shock tube wherein detonation velocities are in the range of about 5,000 feet per second to 7,000 feet per second.

Notwithstanding this fact and to provide a low cost alternative to the explosive detonation cords known in the art, the signal transmission line of this invention is compatible with other signal transmission devices such as shock tube, blasting caps, etc. which permits lumped delay elements, tube connectors, splices, and the like to be included in blasting systems of the present invention. The low velocity signal transmission line can reliably propagate a signal to and from these devices as well as be initiated by a variety of signal transmission or signal generating products such as blasting caps, linear explosive cord, shock tube and the like.

The transmission tube of the invention presents little hazard with regard to accidental firing as it is not highly impact, flame or spark sensitive. Successful initiation of the transmission tube of this invention is dependent upon the reception of a strong pressure pulse as generated by the output of a percussion primer, shock tube, blasting cap or detonating cord used in the system as an signal initiation source. The tube, being non-electric, is immune to accidental initiation by electrical phenomena commonly experienced in mining operations. It functions relatively noiselessly and non-disruptively through a resilient tube, transmits a linear signal at rates which permit building the time interval into the tube itself thereby eliminating the need for delay detonators and reliably functions through kinks, gaps, bends and knots while assuring millisecond accuracy.

The following examples 1–22 and tables, Tables I–VIII, illustrate signal propagation rates and functional reliability of some of the above identified deflagration materials.

The following examples are intended to illustrate some embodiments of the subject signal initiation system and tube falling within the scope of the invention without, however, limiting the system and/or tube to the same.

EXAMPLE I

All test formulations of the deflagrating materials were made on weight basis and are expressed as percent fuel and percent oxidizer, or the corresponding ratio. The transmission tube samples were individually weighed before and after being internally coated wtih the deflagrating mixture to determine the coreload or amount of powder contained within each tube.

The test deflagrating compositions comprised a fuel component, with specific surface areas evaluated from approximately 0.14 to 11 square meters per gram ($m^2/g$) and an oxidizer component with specific surface area evaluated from 0.6 to 0.8 $m^2/g$.

Test samples of the transmission tube comprised six 1.2 meter lengths of Surlyn #8940 tubing, possessing a nominal outer diameter of 3.0 millimeters (mm) and a nominal inner diameter of 1.3 mm. Each tube length was then internally coated with a deflagrating mixture.

The deflagrating formulation consisted of 10% silicon (of specific surface area 11.19 $m^2/g$ and 90% red lead (of specific surface area 0.64 $m^2/g$).

The average coreload for this particular set of transmission tubes was 58 milligrams per meter (mg/m). Each tube sample was tested by inserting one end of the tube into a shot shell primer initiation fixture and aligning the inner diameter (ID) of the tube with the output of shot shell percussion primer. (The shot shell percussion primer is a device commonly used in the initiation of shot gun shells). The remainder of the tube was securely positioned within a fixture track monitored by two photodiode timing elements located one meter apart. The impact of the firing pin against the center of the shot shell primer induces the initiation of the primer and, in turn, the tube sample. A successful initiation was evidenced by a flash of light emitting from the tube and its detection by the photodiodes. The impulse from the diodes was transmitted to an electronic counter and recorded in time intervals of milliseconds. These times were later converted to units of milliseconds per foot (ms/ft) and represent the signal propagation rate of each individual tube. The average signal propagation rate for this group of test samples is given in Table I under Signal Propagation Rates.

Reliability, or percent success, was determined by dividing the number of successes (i.e. samples that reacted over entire length) by the total number of samples tested, and is expressed as a percentage. For example, four success in a total of six tests corresponds to a reliability of 67%. Similar calculations were made for each of the formulations and are shown in Table I.

For cases where all of the samples in a test group failed to function over the entire length and reliability was listed as 0% and the Signal Propagation Rate denoted by an "N" (indicating an indeterminate number). One such example relates to the samples fabricated from a mixture of 54% silcon (specific surface area 5.00 $m^2/g$ and 46% red lead (specific sufface area 0.64 $m^2/g$).

EXAMPLE #2

This series of transmission tubes contained fuel component tungsten, with specific surface areas evaluated from 0.021 $m^2/g$ to 1.760 $m^2/g$, intimately mixed with an oxidizer component, potassium perchlorate ($KClO_4$), with specific surface areas evaluated at 0.30 $m^2/g$ and 0.96 $m^2/g$. The specifics as to sample preparation and testing were the same as those described in Example #1. The formulations tested contained ranges of 30%–90% tungsten and 70%–2% potassium perchlorate, respectively. The results of the evaluation are listed in Table II.

EXAMPLE #3

This series of transmission tubes contained deflagrating compositions of fuel component titanium hydride ($TiH_2$), with specific surface areas evaluated from approximately 0.06 $m^2/g$ to 3.11 $m^2/g$, and oxidizer component, potassium perchlorate ($KClO_4$), with specific surface areas of approximatelly 0.25 $m^2/g$ and 1.10 $m^2/g$. Formulations of 60% titanium hydride and 40% potassium perchlorate were tested over the specific surface area ranges given above. The results are shown in Table III.

An additional evaluation examined mixtures of $TiH_2$ (of specific surface area 2.47 $m^2/g$) and $KClO_4$ (of specific surface area 0.96 $m^2/g$) over the formulation ranges of 25/75, 37/63, 48/52, and 60/40, the results are presented in Table IV.

The specifics as to sample preparation and analysis were the same as those described in Example #1.

EXAMPLE #4

Surlyn #8940 tubing was extruded to a nominal outside diameter of 3.0 mm. and a nominal inside diameter of 1.33 mm. Concurrent with the extrusion, the interior of the tube was coated with a mixture of 90% molybdenum and 10% potassium perchlorate (specific surface areas of 0.99 $m^2/g$ and 0.25 $m^2/gram$, respectively) with a mean coreload of 25.4 milligrams per meter for five samples tested.

Five lengths each 1.2 meters long were cut from the above conintuous length of extruded tubing. The signal propagation rates were determined by the method described in Example #1 and were calculated to be 1.066, 1.029, 0.987, 1.069 and 0.990 milliseconds per foot of length, averaging 1.026 ms./ft.

Additional tubing was extruded in the same manner except the deflagrating material coreload was increased to an average of 50.5 milligrams/meter. The individual reaction rates were calculated to be 1.265, 1.340, 1.298, 1.398 and 1.259 ms./ft, with the average of the five samples being 1.312 ms/ft.

EXAMPLE #5

Transmission tubing was prepared in the same manner as in Example #4 except that the deflagrating material used was a intimate mixture of a 31.4 grams of Silicon (37% by weight) fuel component with a specific surface area of 5.65 $m^2$/gram and 18.6 grams of oxidizer component Red Lead (62% by weight) with 1% by weight of Viton$^R$ A, a Fluoroelastomer manufactured by E. I. DuPont de Nemours and Co, Inc. The mixture was prepared by initially dissolving 0.55 grams of Viton$^R$A in 24.0 grams of Acetone, that in turn was added to a liquid Freon TA$^R$ solution to intimately wet mix the silicon, Red Lead and Viton$^R$A. The resultant mix was grained, dried and screened and then processed in the same manner as in Example #4. Four samples were tested in accordance with the method described in Example #1 and yielded the calculated signal propagation rates of 5.16, 4.74, 4.08 and 4.29 milliseconds per foot. The average propagation rate was 4.57 ms/ft.

EXAMPLE #6

Sets of four 1.2 meter lengths of silicone rubber tubing (small: 3.25 mm O.D., 1.55 mm I.D. and large: 6.25 mm O.D., 4.3 mm I.D.) and polyolefin tubing (small: 6.25 mm O.D., 4.05 mm I.D. and Large 0.375 mm O.D., 6.075 mm ID) were aspirated with a mixture of 60% tungsten (specific surface area, 0.36 $m^2$/g) and 40% potassium perchlorate (specific surface area 0.96 $m^2$/g). Coreloads averaged 114 mg/m and 358 mg/m for the small and large silicone tube samples, respectively and 153 mg/m and 203 mg/m for the small and large polyolefin tube samples, respectively. Each test sample was initiated by a percussion primer and the signal propagation rate determined according to the method described in Example #1.

Signal propagation rates for the small and large O.D. silicone tube samples were 0.725 ms/ft and 1.098 ms/ft, respectively. Propagation rates for the small and large O.D. polyolefin tube samples were 0.393 ms/ft and 0.489 ms/ft, respectively (Table V).

These results indicate the effect of tubing size and composition on signal propagation rate. In addition, in this range of tube dimensions, increases in tube size (O.D. and I.D.) cause a reduction in the reaction rate. Additionally, a flexible, relatively "soft" tube (e.g. silicone) reduces the rates of signal transmission. Conversely, a more rigid tube (e.g. polyolefin) transfers the chemical deflagration reaction directly along the length of the tube with only a negligible loss to wall absorbtion.

EXAMPLE #7

Sets of four 1.2 meter lengths of small and large O.D. polyolefin tubing and silicone rubber tubing dimensions as specified above in Example #6 were aspirated with a mixture of 48% titanium hydride (specific surface area 2.47 $m^2$/g) and 52% potassium perchlorate (specific surface area 0.96 $m^2$/g). Average coreloads were as follows: 94 mg/m and 58 mg/m for the small and large O.D. polyofelin tubing, respectively; 27 mg/m and 125 mg/m for the small and large O.D. silicone tubing, respectively. The samples were tested individually by the method cited in Example #1. Signal propagation rates averaged 0.208 ms/ft and 0.223 ms/ft for the small and large O.D. polyofelin tubing and 0.291 ms/ft and 0.358 ms/ft for the small and large O.D. silicone tubes (Table V).

EXAMPLE #8

The transmission lines consisted of Surlyn #8940 tubing with sizes evaluated from the standard 3.0 mm OD by 1.3 mm ID, as cited in earlier examples, to 4.2 mm OD, by 1.8 mm ID with coreloads of intimate mixture of 61% TiHhd 2, 33% $KClO_4$, and 6% HMX with coreloads evaluated from 11 to 32 milligrams per meter. The resultant samples were tested by the method of Example #1. The test results are shown in the upper portion of Table VII. The evaluation was then repeated with the same deflagrating components, the same range of tube coreloads, and the same external tube surface, except that the internal configuration was changed from the above smooth cylindrical cross section to that created by placing four equally spaced slots into the die that forms the inside of the tube. A cross section of the resultant tube is shown as FIG. #7, the test results are shown in the bottom of Table VII.

By changing the internal configuration of the tube, while holding all other variable constant, the average propagation rate was changed from 0.274 ms/ft to 0.306 ms/ft, or overall reduction of 11.7%. The reduction was more pronounced at an intermediate coreload level where the average was reduced from 0.266 ms/ft to 0.312 ms/ft or 17.3%.

EXAMPLE #9

The test of Example #8 were repeated except that the composition of the deflagrating material comprised an intimate mixture of 94% AIA Ignition Powder, being Zirconium, Ferric Oxide, and Diatomaceous Earth, manufactured to the requirements of military specification MIL-P-22264 Rev A, with 6% HMX added as a gas generating compound. This deflagrating composition was evaluated over the same range of dimensions as for the above example #8, including the alternate inner tube configurations, except that the cylindrical ID tubing tests were limited to 1.3 mm ID. The results of the evaluation, as shown in Table VIII, depict a reduction from 0.460 ms/ft to 0.609 ms/ft or 32% for equivalent 1.3 mm ID.

The overall average reduction in propagation rate for all samples tested was from 0.460 ms/ft to 0.575 ms/ft or a reduction of 25%.

Examples #1, 2, 3, 4, and 5 identify potential signal propagation rates of 0.21 to 0.516 ms/ft. Examples #8 and #9 demonstrate a further reduction in the propagation rate by 11.7 to 32%. Those skilled in the art can easily realize that other fuels, oxidizers, diluents, inert materials, propellants, or deflagrating explosives (used in combination as primary or secondary constituents) or with other core configurations that introduce internal surface roughness etc., will adjust or modify the deflagrating rate to a desirable and controllable level between 0.2 ms/ft and 10 ms/ft.

EXAMPLE #10

Surlyn #8940 tubing was extruded to a nominal outer diameter of 3 mm and a nominal inner diameter of 1.33 mm. Concurrent with the extrusion, the interior of tube was coated with a mixture of 50% tungsten and 50% potassium perchlorate (specific surface are 0.36 $m^2/g$ and 0.96 $m^2/g$, respectively). The means coreload was 72 mg/m.

Figure 8A:
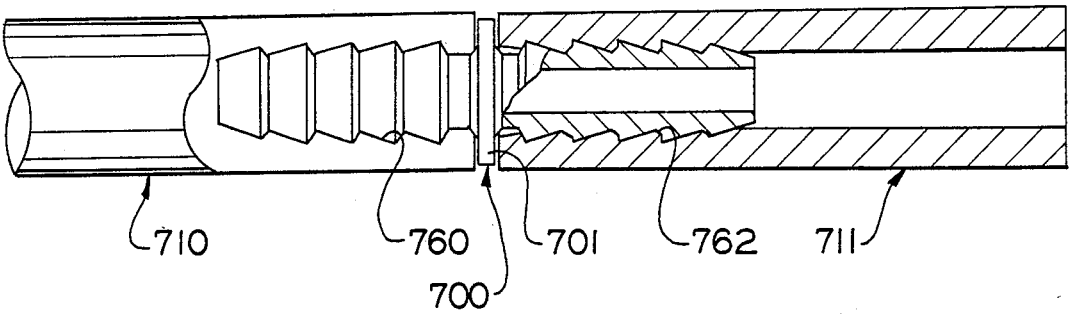
FIGS. 8A, 8B and 8C illustrate connectors used in blasting systems of the present invention to interconnect signal transmission tubes.

Twenty four 1.2 meter lengths were cut from a continuous length of the extruded tubing. Two tube sections were then joined by means of an internal brass metal splice as shown in FIG. 8A, yielding a total of 12 test samples.

Two groups of 6 samples each were tested in the following manner. The first length 710 of coated tube was initiated by a shot shell percussion primer in the manner described in Example #1. This first length 710 served as the initiation impulse "carrier" with the second length 711 functioned as the "receptor". The signal propagation rates of first and second lengths 711 of tubing (six components each) were determined by the method described in Example #1. All sample sets functioned reliably with mean signal transmission rates of 0.352 ms/ft for the first length 710 and 0.501 ms/ft for the second 711 (Table VI).

EXAMPLE #11

Figure 8B:
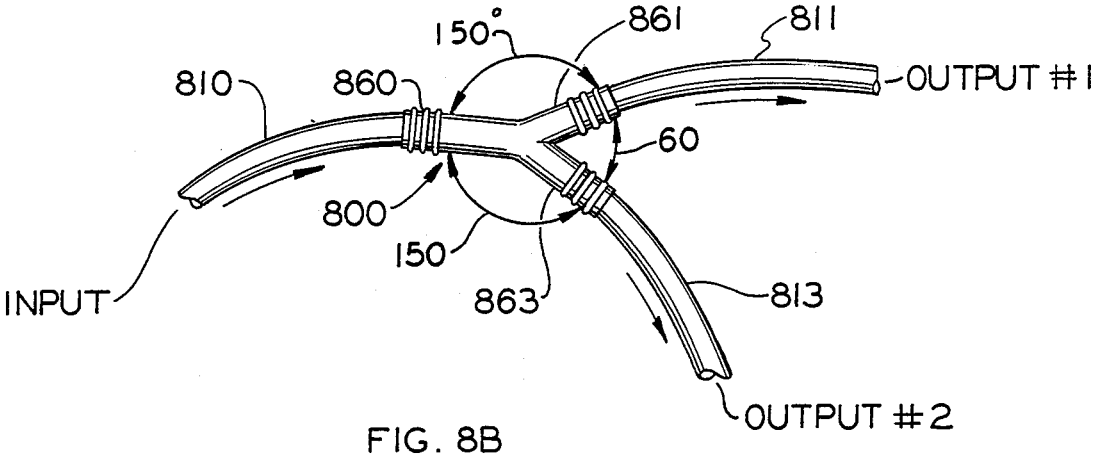

Extruded Surlyn tubing (of the dimensions specified in Example #10) was again used containing deflagrating composition of 60% tungsten (0.36 $m^2/g$ specific area) and 40% potassium perchlorate (0.96 $m^2/g$ specific surface area). Several 1.2 meter lengths, of average coreload 58 mg/m, were cut from a continuous length of extruded tube and inserted into a "Y" connector as shown in FIG. 8B. The first or "input" length 810 of coated tube was initiated by a shot shell percussion primer by the manner described in Example #1. The signal propagation rate of "output" length 811 (signal propagation rate of output 813 is assumed identical to that of output 811) was measured by the timing mechanism cited in Example #1. Samples tested were functional with an average "output" propagation rate of 0.610 ms/ft (Table VI). The mean signal transmission rate for the input length 810 was 0.375 ms/ft.

EXAMPLE #12

Figure 8C:
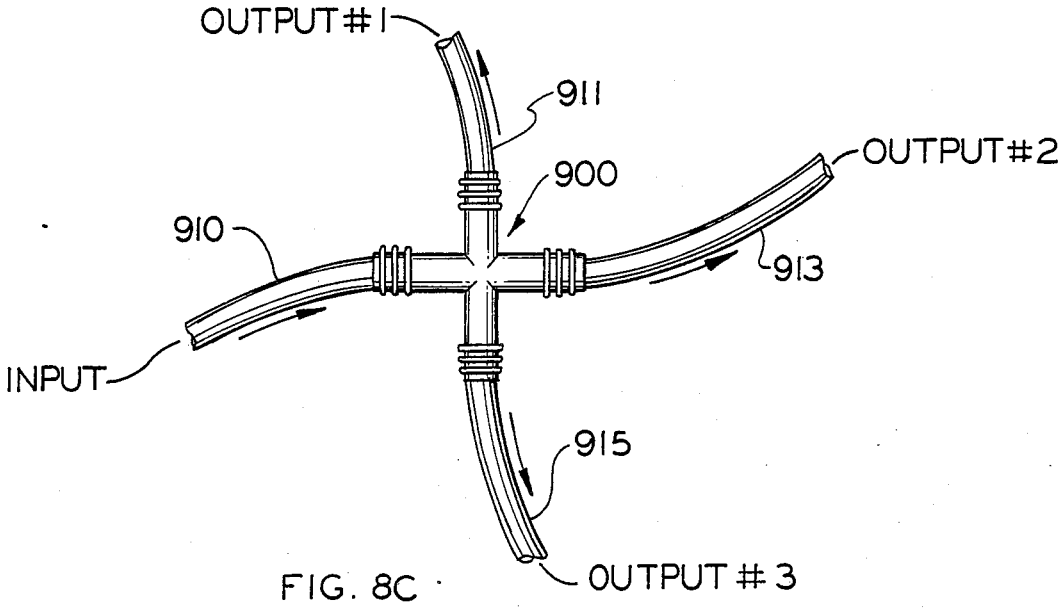

Sample tube material was prepared in an analogous manner to that cited in Example #11 except that the deflagrating composition used was 70% tungsten (0.36 $m^2/g$) and 30% potassium perchlorate (0.96 $m^2/g$). The average coreload was 58 mg/m. Again, 1.2 meter lengths were cut from a continuous length extruded tube area each was inserted into a "4-way" cross connector as depicted in FIG. 8C. The first or "input" length 910 was initiated by the method described in Example #1. The signal propagation rate of "output" lengths 911 and 913 (positioned 90° and 180° respectively to that of the input length) were measured as cited in Example #1. For all practical purposes, the signal propagation rate of output 915 (90° from input lead) was considered identical to that of output 911.

All four sample sets were functional with a mean propagation rate of 0.486 ms/ft for output 911 and 0.485 ms/ft for output 913 (Table VI). The mean signal propagation rate for the input length 910 was 0.426 ms/ft.

EXAMPLE #13

The tests described in Example #10 were repeated with the sole difference being the use of a different deflagrating composition. A 48% titanium hydride (specific surface area 2.47 m 2/g) and 52% potassium perchlorate (specific surface area 0.96 m 2/g) mixture was used in place of the W/$KClO_4$formulation specified in Example #10. The results indicated measurable signal propagation rates of 0.202 ms/ft for the first meter length 710 and 0.199 ms/ft for the second meter length 711 (Table VI).

EXAMPLE #14

The test described in Example #11 reference FIG. 8B were repeated with the only difference being that of the deflagrating composition. The formulation cited in example #13 was used here. The average coreload for the group was 15 mg/m. MEan reaction rates were 0.207 ms/ft for the "input" lengths 810 and 0.207 ms/ft for the "output" lengths 811 (Table VI).

EXAMPLE #15

The tests of Example #12 reference FIG. 8C were repeated with the formulation specified in Examples #13 and #14, being 48/52 titanium hydride/potassium perchlorate composition. The average coreload for the group was 35 mg/m. Measured propagation rates were 0.229 ms/ft for output lengths 913 and 915 (located 90° from the input lead) and 0.209 ms/ft for output length 911 (located 180° from the input lead, see Table VI).

EXAMPLE #16

Extruded Surlyn #8940 tubing (of the same dimension cited in Example #10) containing a mixture of 70% Tungsten (specific surface area 0.36 m2/g) and 30% Potassium perchlorate (0.96 m2/g specific surface araea) was tested for its suitability to initiate a blasting cap. The mean coreload of the tube was 66 mg/m. Thirty-inch lengths of tubing were used. One end of the tube was crimped into an instant (0 ms) blasting cap and the other end left free and open. Samples were prepared by centering the tube in the cap by means of a conventional rubber bushing and securing the unit (cap and tube) with a conventional crimp.

Signal propagation times were determined by cap initiation using an 18 inch length of Primaline$^R$. The free end of the tube was initiated by a shot shell percussion primer using the method cited in Example #1. Transmission of the deflagrating impulse through the tube subsequently initiated the dextrinated Lead Axide top charge and PETN base charge contained within the blasting cap. This in turn initiated the length of Primaline$^R$ with the impulse signal being detected by piezo crystals and finally transmitted to a chronograph. The results were measured in milliseconds with comparisons having been made between control samples (shock tube/cap) and test samples of (transmission tube/cap). The observed signal propagation times were essentially the same for the two groups.

EXAMPLE #17

Test samples were prepared identically to those described in Example #16 with the sole difference being the use of a delayed action blasting cap in place of the instant cap. In this case a 200 millisecond delay unit was utilized.

Reaction times were determined according to the manner described in Example #16. Test samples (transmission tube/cap) had a mean reaction time of 199.3 ms.

EXAMPLE #18

The ability of transmission tube of this invention to be initiated by means other than shot shell percussion primer was examined. For this example, extruded transmission tube material containing a mixture of 60% Titanium hydride and 40% Potassium perchlorate was tested. The dimensions of the tube were the same as those specified in Example #10.

An instant blasting cap was taped to one end of a 3 meter length of transmission tube. The lap joint was approximately one-inch. The remainder of the transmission tube was secured in the fixture as described in Example #1. The cap unit was initiated by a shot shell percussion primer and the propagation rate for the transmission tube sample determined according to the method cited in Example #1. The tube of the invention was initiated from a blasting cap successfully with a propagation rate of 0.216 ms/ft. This rate was essentially unchanged from that determined by the shot shell primer initiation method (0.218 ms/ft).

EXAMPLE #19

Initiation by detonating cord was examined. Extruded transmission tube having dimensions as stated in Example #10 and containing a deflagrating mixture of 70% tungsten and 30% potassium perchlorate was used.

A three-inch length of 25 grain/foot detonating cord was lap connected (one-inch) to an instant blasting cap unit (same as that used in Example #18) and one end of the transmission tube lead. A total length of 3-meters of transmission tube was again used. The cap unit was initiated by a shot shell percussion primer and the signal propagation rate of the transmission tube was determined in the manner described in Example #1.

The successful initiation of the transmission tube resulted in an observed signal propagation rate of 0.429 ms/ft. This is unchanged from that observed for shot shell primer initiation.

Examples of #18 and #19 indicate the adaptability of the device of this system to various initiation devices and methods.

EXAMPLE #20

Six instant cap units (30 inch length of 70/30 W/$KClO_4$ transmission tube) were assembled in the manner described in Example #16. The mean coreload of the tube material was 66 mg/m. Each unit was then incorporated into a 4-way cross connector. A thirty-inch lead length was used for the input lead with the cap unit interfaced at 90°. Test samples were initiated and analyzed according to the methods outlined in Example #16. The mean propagation time was 0.22 ms indicating a significant reduction from the initial value of 0.01 ms (see Example #16).

EXAMPLE #21

This example is an extension of Example #20 as the identical transmission tube material (formulation, coreload, etc.) was used. Instant units were interfaced through three 4-way cross connectors which required the signal to traverse three 90° angle turns. In addition, a one-inch gap between the tubes was imposed in each connector.

Each of six test samples was analyzed in the manner described in Example #16. The average propagation time for the instant cap was 1.86 ms indicating a reduction from the initial time of 0.01 ms.

EXAMPLE #22

Figure 9:
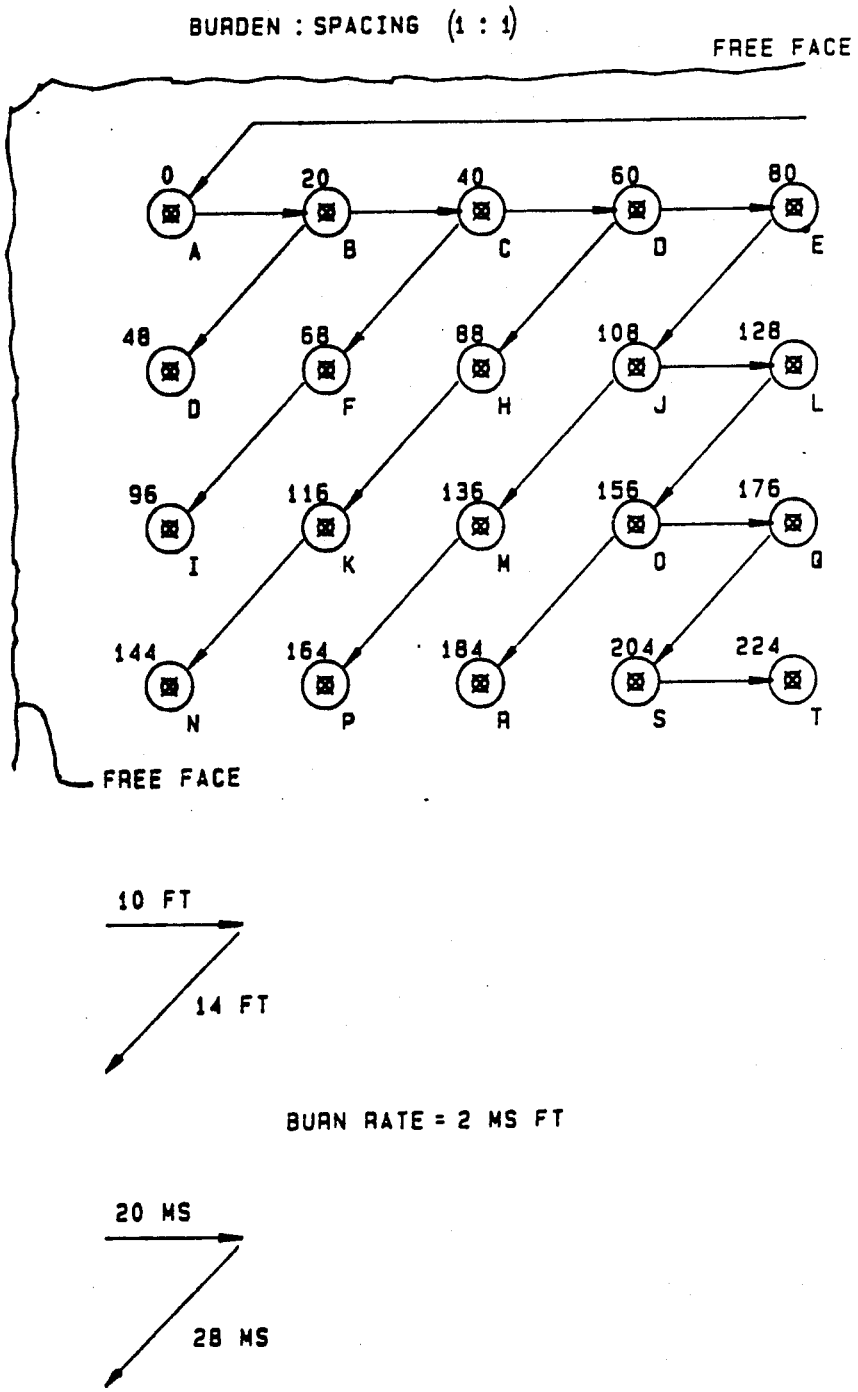
FIG. 9 is a schematic diagram of the blast pattern shown in FIG. 2 illustrating the shot pattern and initiation sequence of FIG. 2 using the system and device of the present invention.
Figure 10:
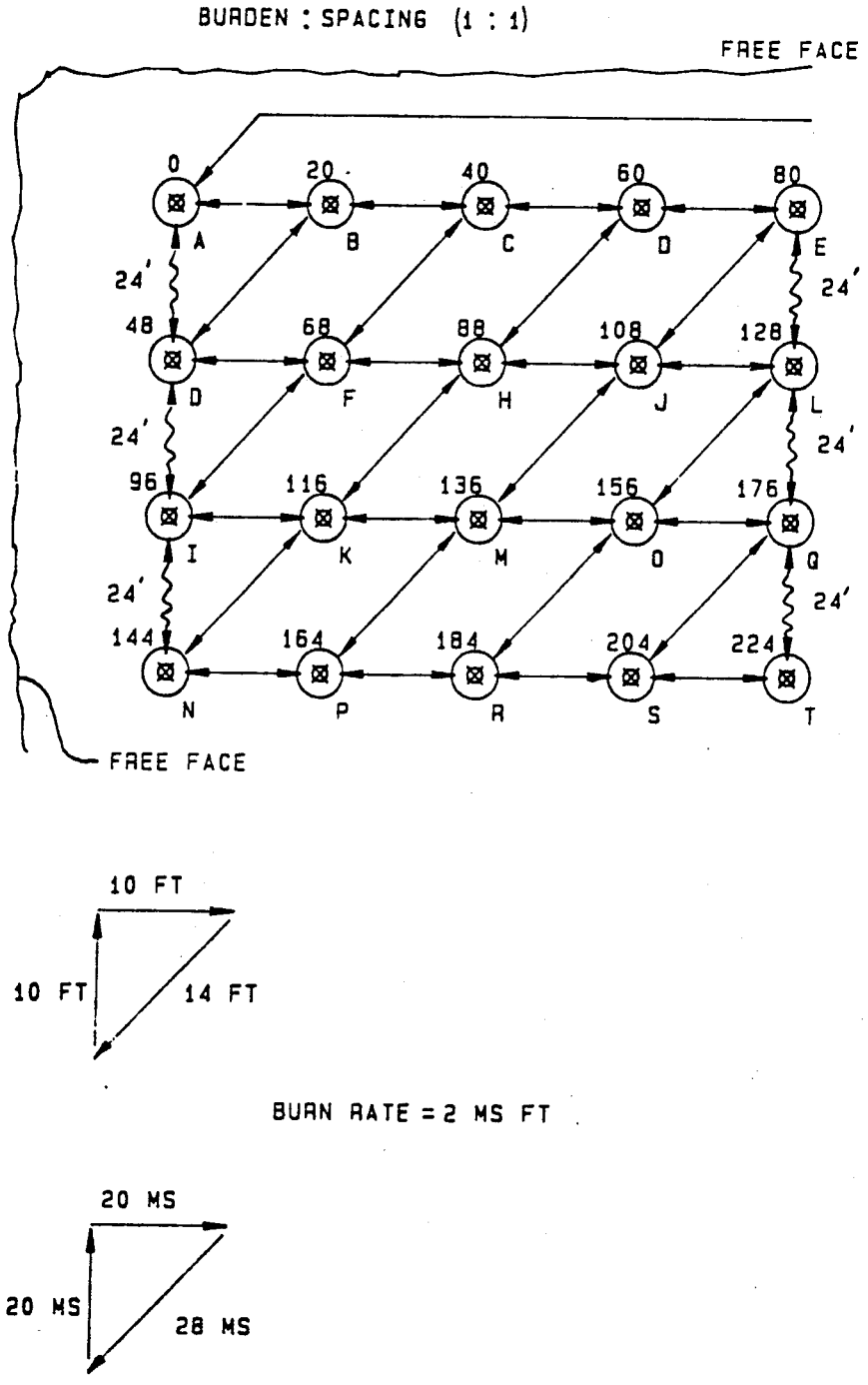
FIG. 10 is a schematic diagram similar to that of FIG. 9 for the blast pattern of FIG. 3.

A diagram showing a typical field shot pattern and borehole spacing is given in FIG. 9. Each borehole is identified by a letter A–T, "A" being the first hole to be initiated and "T" the last. The triangle in the lower left indicates the distance (and of transmission tube of this invention, the length required) between adjacent holes and rows of holes. In this case the spacing (i.e. distance between adjacent holes being parallel to the free face) and the burden (i.e. distance between boreholes measured perpendicular to the free face) are equivalent.

At a propagation rate of 2 milliseconds/foot, the actual firing time at the collar of each borehole would be 20 ms apart as one follows the spacing orientation (moving horizontally from left to right) and 28 ms apart as one follows the burden orientation (moving vertically from top free face to bottom). The numbers at each hole represent the approximate surface initiation times (in milliseconds) relative to the firing of the first hole, A, at 0 ms. The solid lines adjoining each hole represent the location of each transmission tube lead line. In an actual field setup, these lines would be networked through 4-way cross connectors (FIG. 8C) at the collar of the holes. The arrowheads indicate the direction of signal transmission.

In this example, the surface pattern (covering an area slightly more than 120 square feet) would be shot in about 224 ms. The holes are fired consecutively from A to T. This time does not take into account the charges in the holes and therefore does not represent the total interval required to complete the blasting sequence. However, the 8 ms delta (minimum delay period between any two holes) is achieved.

A small scale version of such a field setup (9-hole square shot pattern, 8 foot burden and spacing) was tested for reliability. Extruded transmission tube containing a 70/30 mixture of W/$KClO_4$ was used. As the average propagation rate for this material was approximately 0.4 ms/ft, no attempt was made to achieve the 8 ms delta between holes. This was purely a test to determine functional reliability.

All transmission tube leads were connected in sequence by means of 4-way cross connectors. No holes or charges (blasting caps, etc) were incorporated into the system, however. Rather, all remaining connector arms were fitted with a 4-foot length of transmission line simulating a downline. The end of each downline was sealed by a piece of tape. Verification of firing was determined by the perforation of this tape.

A point of concern in field shots is the possibility of misfired holes due to a damaged lead line. One way to amend this situation is to provide redundancy in the shot pattern. This concept is exemplified in FIG. #10. The basic parameters of propagation rate, spacing, etc, are the same as those given in FIG. 9. However, each hole (with the exception of the initiation hole A) is supplied by at least 2 transmission tube leads. This interconnecting then provides added assurance for fail safe initiation of each element should one lead fail in series. In order to maintain the identical timing sequence, (10–224 ms), longer leads (24 feet each) or tubing having a different propagation rate would be required to link the outermost boreholes on the left and right hand sides of the pattern. These lines are indicated by a wavy line.

The concept of redundancy in a field pattern as described above was tested. The basic format was identical to that of Example #22 with the inclusion of transmission tube tie-in line.

The lead line to the first hole (A) was initiated by a shot shell percussion primer. This provided the impetus for the firing of the entire system. The pattern functioned reliably for the conditions outlined above.

By examination of the shot pattern (i.e., burden, spacing, square or offset drill pattern, etc.) one can readily determine the transmission tube lead lengths or desired propagation rates of tubing and surface time required to meet any field application.

TABLE I

Si/$Pb_3O_4$ FUNCTIONAL RELIABLITY, SIGNAL PROPAGATION RATE, AND CORELOAD AS A FUNCTION OF SURFACE AREA AND FORMULATION

| Si Surface Area[1] | | 11.19 | 5.00 | 1.49 | 1.36 | 0.36 | 0.16 | 0.14 |
|---|---|---|---|---|---|---|---|---|
| | | RELIABILITY | | | | | | |
| | % Si[2] | | | | | | | |
| 0.64 m2/g $Pb_3O_4$ | 10 | 67% | 17% | 0% | 0% | 0% | | 0% |
| | 20 | 100% | 100% | 67% | 33% | 0% | 0% | |
| | 37 | 17% | 33% | 50% | 83% | 0% | | |
| | 54 | 0% | 0% | 67% | 17% | 67% | 0% | 0% |
| 0.75 m2/g $Pb_3O_4$ | 10 | 83% | 0% | 0% | 0% | 0% | | |
| | 20 | 100% | 83% | 33% | 33% | 0% | | |
| | 37 | 67% | 67% | 67% | 50% | 0% | | |
| | 54 | 0% | 17% | 50% | 33% | 0% | 0% | 0% |
| | | SIGNAL PROPAGATION RATES (msec/ft) | | | | | | |
| | % Si | | | | | | | |
| 0.64 m2/g $Pb_3O_4$ | 10 | 0.680 | 0.619 | N | N | N | | N[3] |
| | 20 | 0.586 | 0.706 | 0.618 | 0.778 | N | N | |
| | 37 | 0.842 | 0.732 | 0.588 | 0.681 | N | | |
| | 54 | N | N | 0.643 | 2.454 | 0.760 | N | N |
| 0.75 m2/g $Pb_3O_4$ | 10 | 0.621 | N | N | N | N | | |
| | 20 | 0.563 | 0.580 | 0.818 | 0.749 | N | | |
| | 37 | 0.578 | 0.717 | 0.608 | 0.818 | N | | |
| | 54 | N | 1.006 | 0.743 | 0.651 | N | N | N |
| | | CORELOAD (mg/m) | | | | | | |
| | % Si | | | | | | | |
| 0.64 m2/g $Pb_3O_4$ | 10 | 58 | 83 | 44 | 56 | 77 | | 123 |
| | 20 | 37 | 53 | 45 | 52 | 51 | 39 | |
| | 37 | 23 | 33 | 33 | 41 | 40 | | |
| | 54 | 80 | 51 | 43 | 60 | 70 | 93 | 47 |
| 0.75 m2/g $Pb_3O_4$ | 10 | 51 | 52 | 97 | 83 | 91 | | |
| | 20 | 18 | 65 | 41 | 55 | 72 | | |
| | 37 | 31 | 27 | 34 | 40 | 69 | | |
| | 54 | 71 | 71 | 84 | 56 | 52 | 67 | 54 |

[1]SURFACE AREAS ARE STATED IN SQUARE METERS PER GRAM
[2]THE BALANCE OF THE FORMULATION IS THE OXIDIZER COMPONENT
[3]"N" DESIGNATES AN INDETERMINATE NUMBER (TEST FAILURE)

TABLE II

W/$KClO_4$ FUNCTIONAL RELIABILITY, SIGNAL PROPAGATION RATE AND CORELOAD AS A FUNCTION OF SURFACE AREA AND FORMULATION

| W Surface Area[1] | | 1.760 | 0.360 | 0.084 | 0.030 | 0.021 |
|---|---|---|---|---|---|---|
| | | RELIABILITY | | | | |
| | % W[2] | | | | | |
| 0.96 m2/g | 30 | | 0% | | | |
| $KClO_4$ | 40 | | 0% | | | |
| | 50 | | 67% | | | |
| | 60 | | 67% | | | |
| | 70 | 100% | 100% | 100% | 0% | 0% |
| | 85 | 100% | 100% | 83% | 0% | 0% |
| | 98 | 0% | 0% | 17% | 0% | 0% |
| 0.30 m2/g | 60 | | 100% | | | |
| $KClO_4$ | 70 | 0% | 100% | 33% | 17% | 0% |
| | 85 | 0% | 0% | 100% | 71% | 0% |
| | 98 | 0% | 0% | 0% | 0% | 0% |
| | | SIGNAL PROPAGATION RATES (msec/ft) | | | | |
| | % W | | | | | |
| 0.96 m2/g | 30 | | N[3] | | | |
| $KClO_4$ | 40 | | N | | | |
| | 50 | | 0.332 | | | |
| | 60 | | 0.338 | | | |
| | 70 | 0.377 | 0.383 | 0.509 | N | N |
| | 85 | 0.465 | 0.440 | 0.686 | N | N |
| | 98 | N | N | 0.937 | N | N |
| 0.30 m2/g | 60 | | 0.609 | | | |
| $KClO_4$ | 70 | N | 0.776 | 0.745 | 0.583 | N |
| | 85 | N | N | 0.950 | 0.947 | N |
| | 98 | N | N | N | N | N |
| | | CORELOAD (mg/m) | | | | |
| | % W | | | | | |
| 0.96 m2/g | 30 | | 40 | | | |
| $KClO_4$ | 40 | | 50 | | | |
| | 50 | | 69 | | | |
| | 60 | | 45 | | | |
| | 70 | 50 | 57 | 78 | 43 | 50 |
| | 85 | 113 | 52 | 169 | 17 | 48 |
| | 98 | 86 | 116 | 106 | 178 | 52 |
| 0.30 m2/g | 60 | | 32 | | | |
| $KClO_4$ | 70 | 51 | 45 | 142 | 62 | 230 |
| | 85 | 68 | 31 | 199 | 88 | 65 |
| | 98 | 102 | 39 | 343 | 169 | 104 |

[1]SURFACE AREAS ARE STATED IN SQUARE METERS PER GRAM
[2]THE BALANCE OF THE FORMULATION IS THE OXIDIZER COMPONENT
[3]N DESIGNATES AN INDETERMINATE NUMBER (TEST FAILURE)

TABLE III $TiH_2$/$KClO_4$[1] FUNCTIONAL RELIABILITY AND SIGNAL PROPAGATION RATES AS A FUNCTION OF SURFACE AREA AND FORMULATION

| $TiH_2$ Surface Area[2] | | 3.11 | 2.26 | 0.13 | 0.071 | 0.061 | 0.063[2] |
|---|---|---|---|---|---|---|---|
| 0.96–1.10 m2/g $KClO_4$ | Signal Propagation Rate (msec/ft) | 0.21 | 0.22 | 0.25 | N | N | N |
| | Reliability | 100% | 100% | 100% | 0% | 0% | 0% |
| | Coreload (mg/m) | 44 | 60 | 10 | 44 | 31 | 30 |
| 0.25–0.30 m2/g $KClO_4$ | Signal Propagation Rate (msec/ft) | 0.32 | | 0.22 | 0.318 | 0.295 | N |
| | Reliability | 100% | | 100% | 83% | 17% | 0% |
| | Coreload (mg/m) | 46 | | 4 | 87 | 51 | 9 |

[1]ALL FORMULATIONS ARE 60/40 (w/w) $TiH_2$/$KClO_4$
[2]SURFACE AREAS ARE STATED IN SQUARE METERS PER GRAM
[3]"N" DESIGNATES AN INDETERMINATE NUMBER (TEST FAILURE)

TABLE IV $TiH_2$/$KClO_4$ FORMULATION SUMMARY

| Formulation | | 60/40 | 48/52 | 37/63 | 25/75 |
|---|---|---|---|---|---|
| 0.96 m2/g $KClO_4$ | Signal Propagation Rate (msec/ft) | 0.210 | 0.202 | 0.208 | 0.223 |
| | Reliability | 100% | 100% | 100% | 100% |
| | Coreload | 47 | 35 | 44 | 29 |

TABLE IV-continued

| $TiH_2/KClO_4$ FORMULATION SUMMARY | | | | |
|---|---|---|---|---|
| Formulation | 60/40 | 48/52 | 37/63 | 25/75 |
| (mg/m) | | | | |

1. SURFACE AREAS ARE: 2.47 m2/g for $TiH_2$ and 0.96 m2/g for $KClO_4$

TABLE V

SIGNAL PROPAGATION RATES AND CORELOADS FOR $W/KClO_4$ AND $TiH_2/KClO_4$ FORMULATIONS IN POLYOLEFIN AND SILICONE TUBING

| | POLYOLEFIN | | | | SILICONE | | | |
|---|---|---|---|---|---|---|---|---|
| | small 6.25 mm O.D. 4.05 mm I.D. | | large 9.375 mm O.D. 6.075 mm I.D. | | small 3.125 mm O.D. 1.55 mm I.D. | | large 6.25 mm O.D. 4.3 mm I.D. | |
| | CL | SPR | CL | SPR | CL | SPR | CL | SPR |
| $W/KClO_4$ (70/30) | 50 | 0.391 | 192 | 0.472 | 97 | 0.638 | 443 | 0.801 |
| | 298 | 0.390 | 142 | 0.528 | 170 | 0.655 | 352 | 1.655 |
| | 146 | 0.392 | 312 | 0.467 | 142 | 0.627 | 278 | —[1] |
| | 118 | 0.401 | 166 | —[1] | 47 | 0.982 | 360 | 0.840 |
| Average: | 153 | 0.393 | 203 | 0.489 | 114 | 0.725 | 358 | 1.098 |
| $TiH_2/KClO_4$ (48/52) | 172 | 0.204 | 59 | 0.216 | 47 | —[1] | 270 | 0.307 |
| | 121 | 0.217 | 61 | 0.215 | 16 | 0.301 | 52 | 0.414 |
| | 36 | 0.204 | 36 | 0.242 | 20 | 0.286 | 42 | 0.387 |
| | 46 | 0.207 | 78 | 0.220 | 26 | 0.286 | 135 | 0.327 |
| Average: | 94 | 0.208 | 58 | 0.223 | 27 | 0.291 | 125 | 0.358 |

CL = Coreload in milligrams per meter
SPR = Signal Propagation Rate in milliseconds per foot
[1]No Test - lost data trace

TABLE VI

SIGNAL PROPAGATION RATES FOR SYSTEM ADAPTATIONS BRASS SPLICE, "Y" CONNECTOR AND 4-WAY CROSS

| | Splice[2] | | | 4-way Cross[3] | |
|---|---|---|---|---|---|
| Formulation | 1st | 2nd | "Y" Connector | 180° | 90° |
| | | | $W/KClO_4$ | | |
| 50/50 | 0.352 | 0.501 | | | |
| 60/40 | | | 0.610 | | |
| 70/30 | | | | 0.485 | 0.486 |
| | | | $TiH_2/KClO_4$ | | |
| 48/52 | 0.202 | 0.199 | 0.207 | 0.209 | 0.229 |

[1]Signal propagation rates are given in milliseconds per foot.
[2]1st and 2nd correspond to first and second meter of spliced tube
[3]180° and 90° correspond to the signal output angle.

TABLE VII $TiH_2/KCLO_4/HMX$ Signal Propagation Rate (ms/ft) as a Function of Core Configuration, Internal Diameter, and Coreload

| ROUND ID SIGNAL PROPAGATION RATE (ms/ft) Average Coreload Mg/M | | | | |
|---|---|---|---|---|
| | | 11 | 19 | 32 |
| ID | 1.30 mm | 0.281 | 0.270 | 0.260 |
| | 1.57 mm | 0.286 | 0.272 | 0.268 |
| | 1.82 mm | 0.299 | 0.257 | 0.277 |
| | | Overall Average 0.274 ms/ft | | |

| MODIFIED INTERNAL CONFIGURATION SIGNAL PROPAGATION RATE (ms/ft) Average Coreload mg/m | | | | |
|---|---|---|---|---|
| | | 8 | 19 | 33 |
| ID Equivalent | 1.30 mm | 0.310 | 0.318 | 0.284 |
| | 1.57 mm | 0.337 | 0.320 | 0.274 |
| | 1.82 mm | 0.338 | 0.299 | 0.277 |
| | | Overall Average 0.306 ms/ft | | |

TABLE VIII $Zr/Fe_2O_3/HMX$ Signal Propagation Rate (ms/ft) as a Function of Core Configuration, Internal Diameter, and Coreload

| ROUND ID SIGNAL PROPAGATION RATE (ms/ft) Average Coreload Mg/M | | | | |
|---|---|---|---|---|
| | | 11 | 27 | 35 |
| ID | 1.30 mm | 0.465 | 0.465 | 0.450 |
| | | Overall Average 0.460 ms/ft | | |

| MODIFIED INTERNAL CONFIGURATION SIGNAL PROPAGATION RATE (ms/ft) Average Coreload mg/m | | | | |
|---|---|---|---|---|
| | | 9 | 24 | 31 |
| ID Equivalent | 1.30 mm | 0.566 | 0.598 | 0.664 |
| | 1.57 mm | 0.569 | 0.573 | 0.579 |
| | 1.82 mm | 0.506 | 0.565 | 0.551 |
| | | Overall Average 0.575 ms/ft | | |

Figure 2:
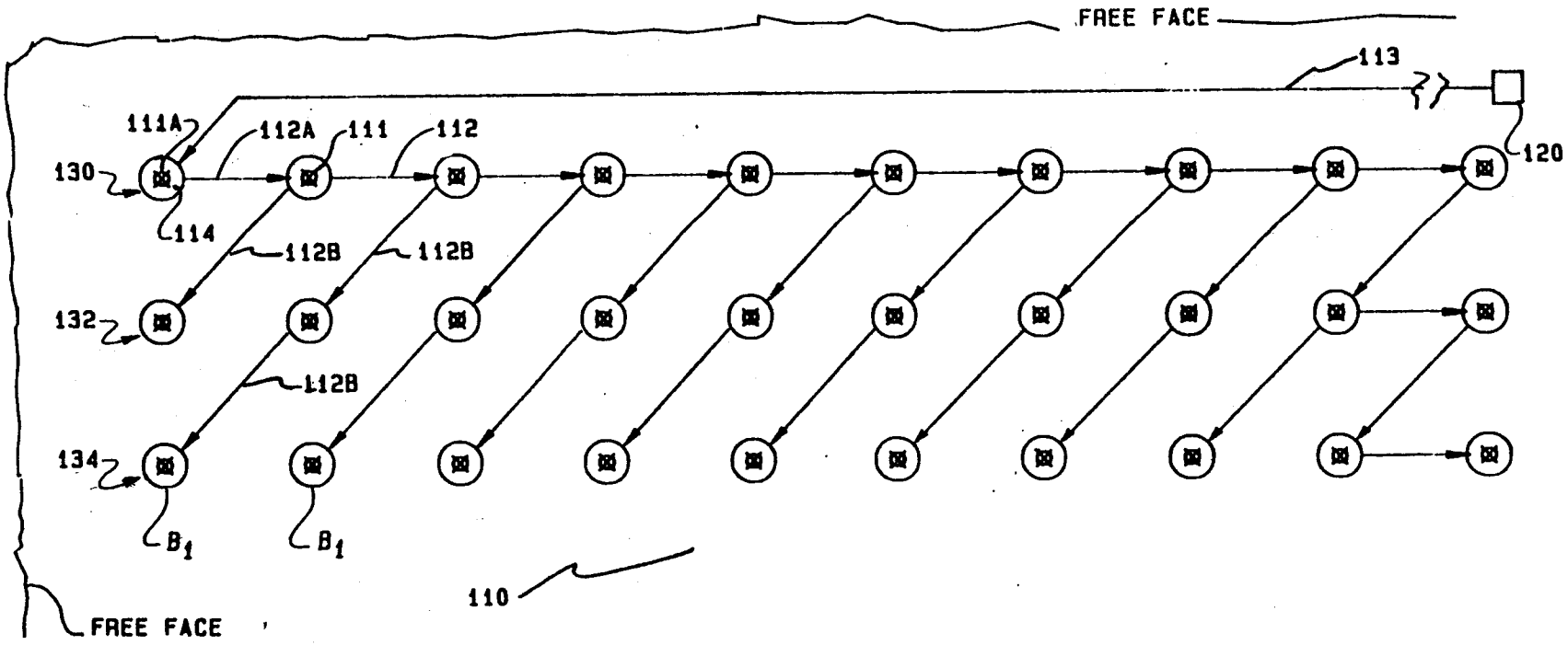
FIG. 2 is a schematic plan view of a second embodiment of the blasting system of this invention wherein a plurality of blasting elements are placed in parallel rows and are linked together in a diagonal or eschelon pattern.

Referring to the figures, FIG. 2 shows a second embodiment of the invention wherein a network of boreholes is initiated by a blasting system signal control system utilizing a plurality of such signal transmission lines described above. The system of FIG. 2 is similar in most respects to the system of FIG. 1, except that the blasting elements 114 are placed in a plurality of boreholes formed in substantially parallel rows 130, 132 and 134 remote of the initiation signal source 120. The rows are interconnected by diagonal transmission lines 112B to form an eschelon blast pattern. It is necessary in the embodiment of the invention of FIG. 2 to incorporate into the system connector means 111 adjacent each borehole (B1) for engaging and interconnecting a plurality of the transmission lines 112 on surface and/or downlines in boreholes (not shown) to propagate the transmission of the initiation signal in the desired pattern for the timed sequential initiation of each blasting element in boreholes.

Any conventional connector used in conjunction with standard linear cord will suffice for the transmission of signal among several discrete lines of low velocity signal transmission line, however, specifically designed connectors such as those illustrated in FIGS. 8A, 8B and 8C are preferred for use with the low velocity transmission tube of this invention.

Suitable connector means for connecting various transmission line segments in the initiation system are generally characterized by a rigid outer surface and a suitably resilient inner layer which when engaged with the abutting transmission tube ends is sufficiently pliable to frictionally support tube ends in place.

For interconnecting two transmission tubes, FIG. 8A illustrates a splice connector 700 formed of metal such as brass having serrated channels 760 and 762 which are of a diameter to be readily inserted into transmission tubes 710 and 711. A hollow splice 701 joins two channels and allows for the deflagrating reaction to pass between tubes. Inclusion of the internal splice imposes two constructions in the ID of tubes 760 and 762. First, it forces the signal to cross a gap of approximately 1cm, and second, it introduces a reduction in the internal tube diameter.

FIG. 8B shows a connector 800 having several channels 860, 861 and 863 with transmission lines 810, 811 and 813 crimped into engagement therewith. The deflagrating reaction follows the lead transmission line 810 into channel 860 of connector and initiates deflagrating reaction in tubes 811 and 813 propagating signal in two directions. For example, the deflagrating reaction via tube 813, may be directed to a down line to initiate a blasting element while the deflagrating reaction, via tube 811, is continued and the process and initiation of tubes is repeated to an unlimited number of blasting elements in a plurality of boreholes.

FIG. 8C illustrates a 4-way connector similar in construction to the connector of FIG. 8B.

Referring once again to FIG. 2, upon initiation of the signal source 120, the signal formed in lead line 113 is then transmitted to first connector 111A which houses open ends of other transmission tubes, such as 112A. The deflagrating material of the tubes is initiated from the pressure/flame front of lead line 113 that in turn initiates tube 112A, and through connector 111 the signal is carried through line 112 and 112B and through connectors etc. and/or down boreholes into contact with blasting element 114.

Figure 3:
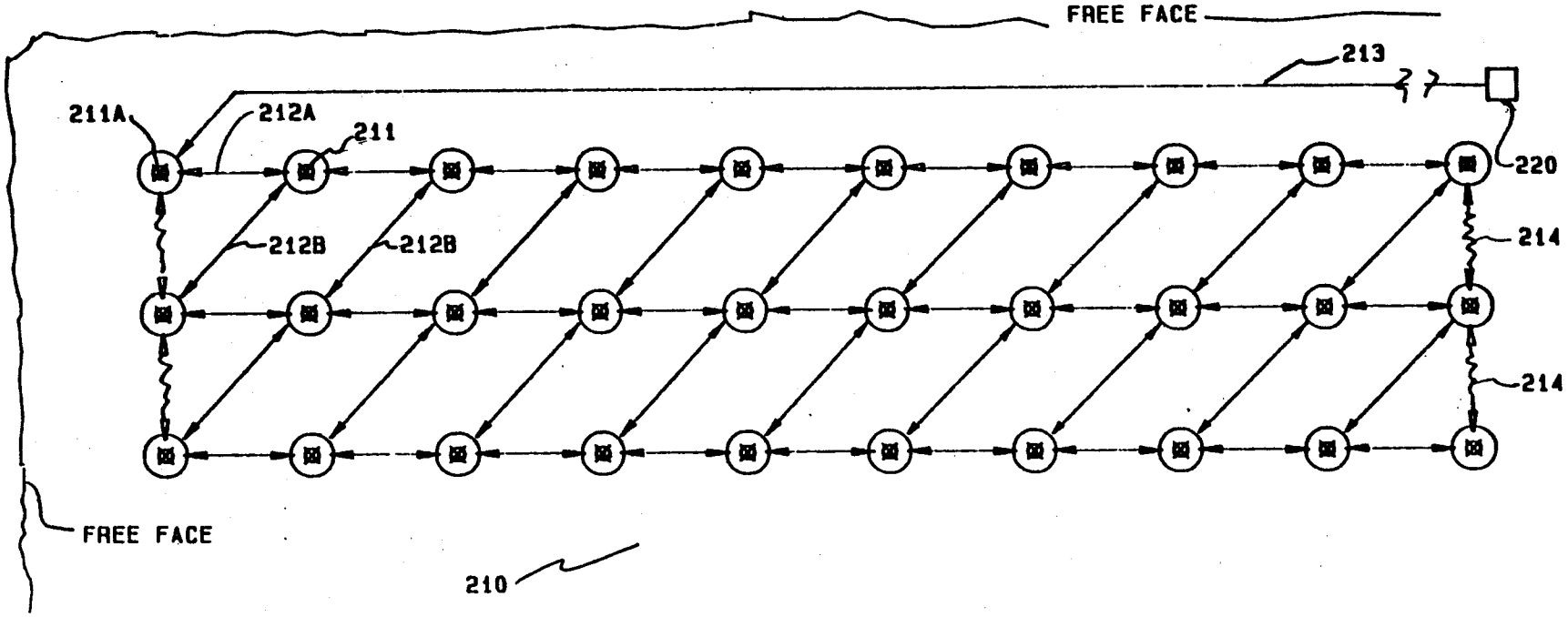
FIG. 3 is another schematic plan view of a third embodiment of the blasting system of this invention illustrating a redundant blasting pattern.

To provide a redundant, fail safe pattern of initiation, each of the blasting elements of FIG. 3 is interconnected to at least two other blasting elements by discrete segments of the transmission line described above to transmit a initiation signal from a initiation source 220. It is to be noted the system of FIG. 3 is similar to that of FIG. 2 except that in this embodiment each blasting element is interconnected to at least one other blasting element in a different row of blasting elements by transmission lines 212B, 214, 216 or 218 to provide a redundant system for the fail safe initiation of each individual blasting element. The connectors 211 of the system may be conventional connectors or those described above which have openings for engaging a plurality of the tubes. The advantages of the system of FIG. 3 are high firing accuracy while eliminating the necessity of having blasting caps located on the surface or within the surface connector elements thereby removing the necessity for primary explosives or explosive gas mixtures to ensure redundancy in initiation.

Figure 4:
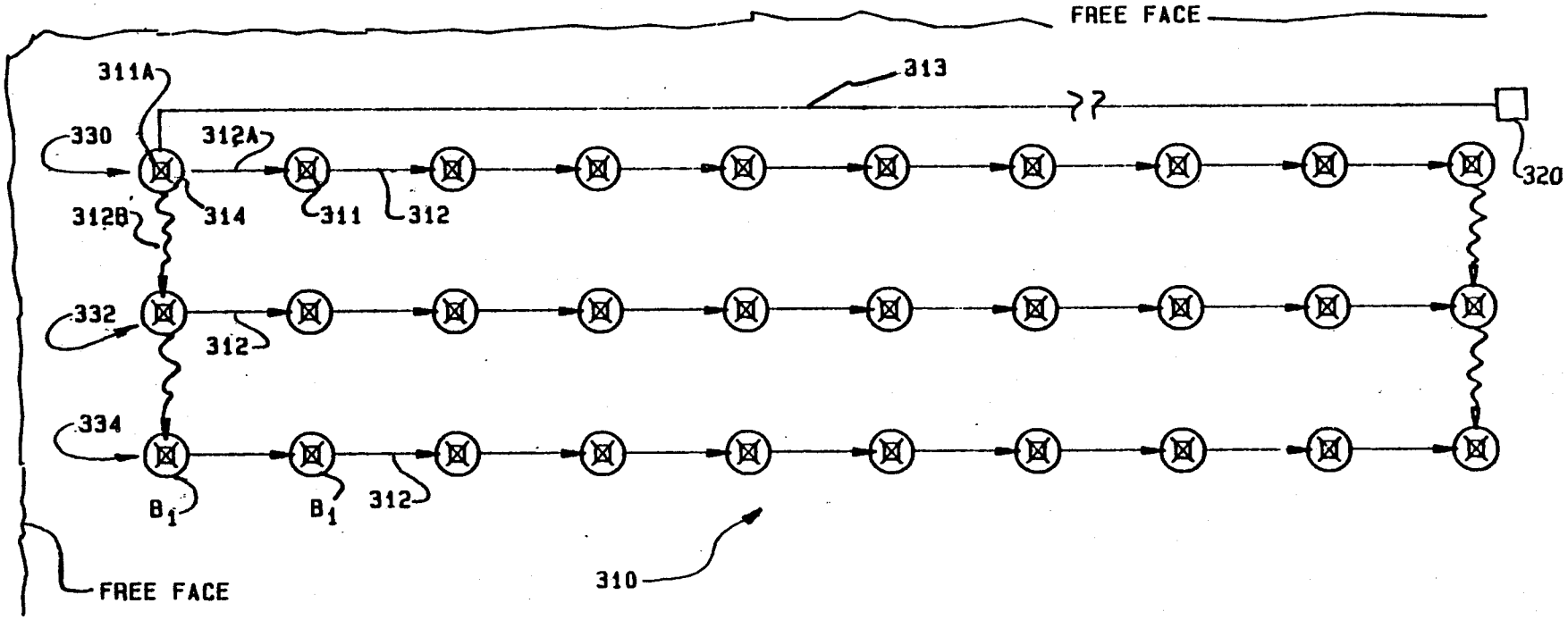
FIG. 4 is a schematic plan view of another embodiment of the blasting system of this invention wherein a plurality of blasting elements are linked together in a series.

FIG. 4 illustrates an embodiment of the blasting system 310 of the present invention similar to that of FIGS. 1, 2 and 3 wherein a plurality of blasting elements 311 in rows 330, 332 and 334 of boreholes are interconnected in series by discrete lengths of transmission tube 312 via connectors 311A and 311.

Figure 5A:
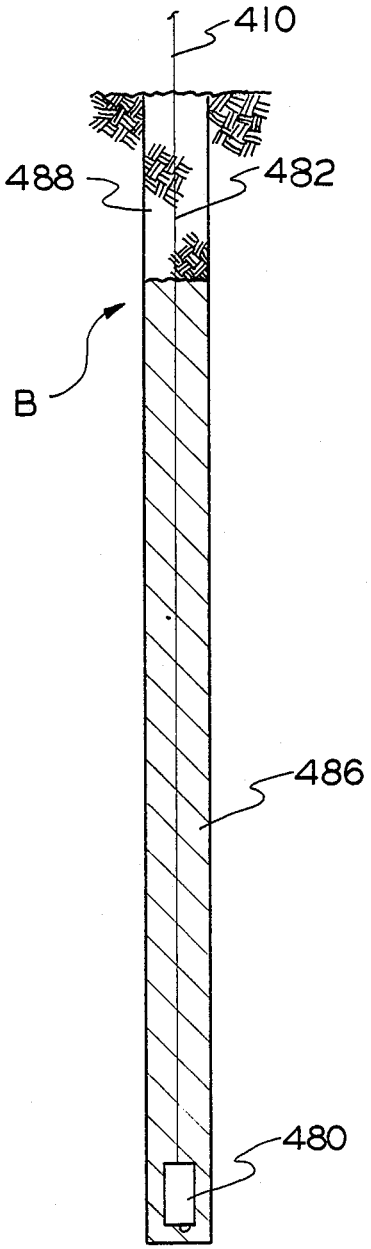
FIGS. 5A and 5B are cross sections of boreholes charged with conventional blasting elements connected to the signal transmission device of the present invention.
Figure 5B:
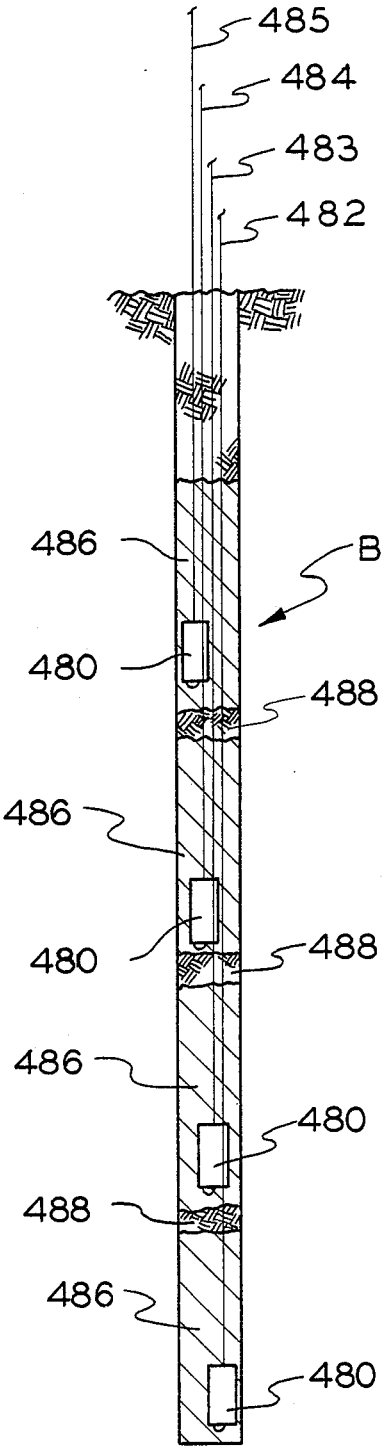

To illustrate the use of the signal transmission tube of this invention to transmit an initiation signal down a borehole to blasting elements, reference is now made to FIGS. 5A and 5B. Transmission tube 410 is used to provide the control for initiation of a single blasting element 486 in borehole B, FIG. 5A, or a pluralit of spaced blasting elements 486 in borehole B, as shown in FIG. 5B.

In FIG. 5A, a primer 480 is connected to a downline 482, formed of the transmission tube of this invention, and is fed into borehole B. Thereafter explosive material 486 is charged around primer 480. A stem of earth forming barrier 488 is packed above explosive material.

FIG. 5B illustrates a blasting system formed in accordance with the method of this invention and as discussed with reference to FIG. 5A. A series of primers 480 each connected to discrete transmission tube 482–485 is dropped into borehole B having explosive materials 486 charged around each primer. Each charge is insulated from the next by earthen barrier 488. Consequently, each of the successive explosive charged 486 can be initiated in time sequence, the sequence being solely determined by the propagation rate of transmission tube without lumped delay elements.

As will be apparent to persons skilled in the art, various modifications, adaptations and variations of the foregoing specific disclosure can be made without departing from the teachings of this invention.

We claim:

1. A nonelectric blasting system for the time controlled transmission of an initiation signal to achieve pattern initiation of a plurality of blasting elements comprising:

an initiation signal source means, a plurality of individual blasting elements, and transmission means for communicating the initiation signal from said initiation signal source means to the individual blasting elements, said transmission means including a plurality of discrete transmission lines connected to selected blasting elements, each of said discrete transmission lines having deflagrating material therein to provide a substantially uniform signal transmission rate per unit length with at least two of such lines having a different signal transmission time between said signal source means and the individual blasting element with which it communicates, the rate of communication of initiation blasting signal from said initiation source means to selected blasting charges being determined solely by the signal transmission rate of the deflagrating reaction of the transmission lines.

2. The system of claim 1 wherein said transmission line means includes tubes, each tube having an imperforate outer jacket and a central passageway therethrough with said deflagrating material selected to provide a predetermined signal transmission rate of less than 5,000 feet per second but greater than 100 feet per second adhered to the inner surface of said tube for propagation of a low velocity signal within said passageway.

3. The initiation system of claim 2 further including at least one spaced apart connector having means for engaging a plurality of said tubes to propagate signal between different tubes, separate lengths of said tube abutted within said connector for transfer of signal between tubes for the times sequential initiation of each blasting element different from at least one other blasting blasting element through the substantially uniform signal transmission rate from initiation signal source means to each blasting element.

4. The system of claim 2 wherein said deflagrating material comprises silicon-red lead, tungsten-potassium perchlorate, titanium hydride-potassium perchlorate, or molybdenum potassium perhchlorate or zirconium-ferric oxide.

5. The system of claim 2 wherein the quantity of said deflagrating material is about 0.010 to about 0.5 grams per meter length of said tube.

6. The system of claim 2 wherein said deflagrating material is comprised of a main fuel component having a surface area greater than 0.02 square meters per gram and a main oxidizer component having a surface area greater than 0.2 square meters per gram.

7. The system of claim 2 wherein said tube is resilient to forces of said deflagrating material.

8. The system of claim 2 wherein inner surface of said tube includes rectangular projections integrally formed therewith which modifies the signal propagation rate of said tube.

9. A nonelectric blasting system for the timed controlled transmission of an initiation signal to achieve pattern initiation of blasting elements comprising:

an initiation signal source means, and a plurality of individual blasting elements, transmission means for communicating an initiation signal from said initiation signal source means to the individual blasting elements, said transmission means including a plurality of discrete transmission lines connected to selected blasting elements, said transmission lines includes imperforate tubes, each tube having a central passageway therethrough and a deflagrating material selected to provide a predeterminable transmission rate of less than 5,000 feet per second but greater than 100 feet per second adhered to the inner surface of said tube for propagation of a low velocity signal within said passageway, said discrete transmission lines each having a substantially constant signal transmission rate per unit length, with at least two of such lines having a different signal transmission time between said initiation signal source means and the individual blasting element with which the line communicates, at least one spaced apaart connector having means for engaging a plurality of said tubes and propagating initiation signal between different tubes, separate lengths of said tube abutted within said connectors to interconnect blasting elements for the timed sequential initiation of each blasting element different from at least one other, the initiation of each blasting element soley determinable by the substantially constant signal transmission rate of transmission line.

10. A method of initiating a plurality of blasting elements in a time controlled pattern wherein an initiation signal is transmitted from an initiation signal source means to a plurality of remote blasting elements, the method comprising the steps of placing a plurality of individual blasting elements in a plurality of boreholes remote from said initiation signal source means, interconnecting a plurality of signal transmission means having deflagrating materials therein for communicating the initiation signal from said initiation source means to the individual blasting elements, the signal transmission means solely controlling the initiation of each individual blasting element through a sustantiallly uniform predeterminable signal transmission rate of less than 5,000 feet per second but greater than 100 feet per second.

11. The method of initiating a plurality of blasting elements of claim 10 further including installing at least one spaced apart connector having means for engaging a plurality of said signal transmission means to propagate signal between different signal transmission means for the timed sequential initiation of each charge different from at least one other through the substantially constant signal transmission rate from initiation source means to each blasting element.

12. A signal transmission device used in a nonelectric blasting system for the time controlled transmission of an initiation signal to achieve pattern initiation of a plurality of blasting elements, the device comprising:

an imperforate tube having a central passageway therethrough, a deflagrating material adhered to inner surface of said tube and extending along the length of said central passageway for propagation of a low velocity signal within said central passageway, said deflagrating material having a substantially uniform predetermined deflagrating rate per unit length of tube of less than 5,000 feet per second but greater than 100 feet per second, and comprised of a main fuel component having a surface area greater than 0.02 square meters per gram and a main oxidizer component having a surface area greater than 0.2 square meters per gram and wherein the quantity of said deflagrating material is about 0.01 to about 0.5 grams per meter length of said tube.

13. The device of claim 12 wherein said deflagration material comprises silicon-red lead, tungsten-potassium perchlorate, titanium hydride-postassium perchlorate molybdenum-potassium perchlorate or zirconium-ferric oxide.

14. The device of claim 13 wherein said deflagration material includes a velocity inhibiting polymer.

15. The device of claim 12 wherein said tube is resilient to forces of said deflagrating material.

16. The device of claim 12 wherein said tube comprises a first tube having an inner and outer surface, deflagrating material adhered to said inner surface, and an outer coating coextensively adhered to said outer surface of said first tube and having high resistance to external damage and mechanical stress.

* * * * *